US006286589B1

(12) United States Patent
Uehara

(10) Patent No.: US 6,286,589 B1
(45) Date of Patent: Sep. 11, 2001

(54) CONDENSER

(76) Inventor: Haruo Uehara, 1544-119, Ooaza-Kinryu, Kinryu-Machi, Saga-Shi, Saga-Ken (JP)

( * ) Notice: Subject to any disclaimer, the term of this patent is extended or adjusted under 35 U.S.C. 154(b) by 0 days.

(21) Appl. No.: 09/550,289

(22) Filed: Apr. 14, 2000

(30) Foreign Application Priority Data

May 31, 1999 (JP) ..... 11-152890

(51) Int. Cl.[7] ..... F28F 3/00
(52) U.S. Cl. ..... 165/166; 165/146; 165/167
(58) Field of Search ..... 165/146, 165, 165/166, 110, 170, 167

(56) References Cited

U.S. PATENT DOCUMENTS 3,255,816 * 6/1966 Rosenblad ..... 165/166
4,180,129 * 12/1979 Sumitomo ..... 165/166
4,182,411 * 1/1980 Sumitomo et al. ..... 165/166
4,228,850 * 10/1980 Sumitomo ..... 165/166
4,314,605 * 2/1982 Sumitomo et al. ..... 165/166

* cited by examiner

*Primary Examiner*—Ira S. Lazarus
*Assistant Examiner*—Terrell McKinnon
(74) *Attorney, Agent, or Firm*—Rader, Fishman & Grauer, PLLC

(57) ABSTRACT

A condenser comprises at least one heat transferring face formed of a plate-shaped material. Change of phase of a low temperature fluid from a liquid phase to a gaseous phase is made by causing a high temperature fluid and the low temperature fluid to flow on opposite surface sides of the heat transferring face, respectively, so that flowing directions of the high and low temperature fluids are perpendicular to each other, to make a heat exchange. There is provided at least one condensate discharging trough portion having a first groove portion formed on a surface of the high temperature fluid side of the heat transferring face so as to extend in an oblique direction to a flowing direction of the high temperature fluid by a prescribed angle. The condensate discharging trough portion is capable of receiving condensate of the high temperature fluid, which is generated on the heat transferring face to flow down in the flowing direction of the high temperature fluid. The heat transferring face is divided into zones by the condensate discharging trough portion. The zones have prescribed patterns of irregularity appearing on at least high temperature fluid side.

10 Claims, 9 Drawing Sheets

CONDENSER

BACKGROUND OF THE INVENTION

1. Field of the Invention

The present invention relates to a condenser for condensing a low temperature fluid through a heat transfer from a high temperature fluid to the low temperature fluid, and especially to a condenser having high condensation efficiency.

2. Description of the Related Art

In general, a condenser is used in a plant of electric generation by temperature difference, steam power, chemistry, food engineering and the like, a refrigerator and a heat pump. Such a condenser can make heat exchange between high temperature fluid and low temperature fluid for the purposes of making change of phase of the high temperature fluid from a gaseous phase to a liquid phase. The conventional condenser maybe classified into a shell and tube evaporator, a plate type evaporator, a spiral type evaporator and the like. The plate type condenser is generally used as a condenser for condensing the high temperature fluid by absorbing heat of the high temperature fluid with the use of the low temperature fluid for example in a plant of electric generation by temperature difference. An example of the conventional condenser is shown in FIGS. 6 and 7. FIG. 6 is an exploded perspective view illustrating essential components of the conventional condenser. FIG. 7 is a schematic descriptive view of the conventional condenser in an assembled condition.

The conventional condenser 100 as shown in FIGS. 6 and 7 is provided with pairs of heat exchange plates 101, 102. In each pair, the heat exchange plate 101 is placed on the other heat exchange plate 102. Upper and lower guide rods 105, 106 held between a stationary frame 103 and a support rod 104 support the pairs of these heat exchange plates 101, 102. The pairs of the heat exchange plates 101, 102 are firmly held between the stationary frame 103 and a movable frame 107 that is mounted on the guide rods 105, 106. Two heat exchange passages A, B are formed on the opposite surfaces of each of the heat exchange plates 101, 102. A high temperature fluid 108 flows in the heat exchange passage A and a low temperature fluid 109 flows in the other heat exchange passage B so as to make heat exchange.

The above-mentioned heat exchange plates 101, 102 having a prescribed shape and a surface condition can be obtained by press-forming a plate-shaped material. Openings "a", "b", "c" and "d" through which the high temperature fluid 108 or the low temperature fluid 109 can pass, are formed at four corners of each of the heat exchange plates 101, 102. Packing members 111, 112 are placed on the surfaces of the heat exchange plates 101, 102, respectively, so as to prevent the heat exchanger fluid 108 and the working fluid 109 from flowing in a mixing condition. The heat exchange plates 101, 102 have the same shape, but the heat exchange plates 102 is placed upside down relative to the normal placement of the heat exchange plate 101.

The heat exchange plates 101, 102 serving as the heat transferring face has a pattern of irregularity (not shown) formed thereon in order to increase the heat transferring area and facilitate the heat transfer from the high temperature fluid 108 to the heat transferring face as well as the heat transfer from the heat transferring face to the low temperature fluid 109.

There is known the other plate type condenser in which, as a part of a pattern of irregularity of a heat transferring face, a plurality of vertical grooves 202 having appropriate pitch and depth are formed on the high temperature fluid side of a heat transferring face 201 as shown in FIG. 8, or a plurality of condensate discharging grooves 302 are formed on a heat transferring face 301 in the oblique direction to the flowing direction of the high temperature fluid as shown in FIG. 9.

When the above-mentioned vertical grooves 202 are formed, condensate of the high temperature fluid, which condenses on the heat transferring face 201, is collected in the trough portions of the vertical grooves through the surface tension of the condensate so that the condensate collected in the trough portion can flow down by its own weight. Accordingly, it is possible to restrain formation of a condensate layer covering the heat transferring face 201 so as to improve the heat transfer efficiency. On the other hand, the above-mentioned condensate discharging grooves 302 receive condensate halfway, which is generated on the heat transferring face 301 to flow down, so that the condensate can be discharged smoothly along the condensate discharging grooves 302. Accordingly, it is possible to prevent the condensate from staying on the heat transferring face 301 so as to improve the contact efficiency of the heat transferring face 301 and the gaseous high temperature fluid.

In the conventional condenser having the above-described structure, although the pattern of irregularity, which facilitates the discharge of the condensate so that the maximum coefficient of heat transfer in the high temperature fluid can be provided, is formed on the high temperature fluid side of the heat transferring face, the low temperature fluid side of the heat transferring face merely has a pattern of irregularity that has an inverse relationship in concavo-convexities to the above-mentioned pattern of irregularity, which is formed on the high temperature fluid side. More specifically, the coefficient of heat transfer relative to the low temperature fluid is not considered in the pattern of irregularity of the low temperature fluid side of the heat transferring face. Accordingly, the heat transfer efficiency is not sufficiently optimized in the heat transfer from the heat transferring face to the low temperature fluid, thus causing energy loss.

SUMMARY OF THE INVENTION

An object of the present invention, which was made to solve the above-described problems is therefore to provide a condenser in which a heat transferring face has shapes by which the heat transfer not only from the high temperature fluid to the heat transferring face, but also from the heat transferring face to the low temperature fluid can effectively be carried out, and a stable and sufficient heat exchange can be made over the entirety of the heat transferring face to facilitate condensation of the high temperature fluid, thus improving the heat exchange efficiency.

In order to attain the aforementioned object, a condenser of the present invention comprises:

at least one heat transferring face formed of a plate-shaped material, change of phase of a low temperature fluid from a liquid phase to a gaseous phase being made by causing a high temperature fluid and the low temperature fluid to flow on opposite surface sides of said heat transferring face, respectively, so that flowing directions of said high and low temperature fluids are perpendicular to each other, to make a heat exchange, wherein:

there is provided at least one condensate discharging trough portion having a first groove portion that is formed on a surface of the high temperature fluid side of said heat transferring face so as to extend in an oblique direction to a flowing direction of the high temperature fluid by a prescribed angle, said at least one condensate discharging trough portion being capable of receiving condensate of the high temperature fluid, which is generated on the heat transferring face to flow down in the flowing direction of the high temperature fluid; and said heat transferring face is divided into a plurality of zones by said at least one condensate discharging trough portion and said zones have prescribed patterns of irregularity, said prescribed patterns of irregularity appearing on at least high temperature fluid side.

According to the present invention, by providing the condensate discharging trough portion for discharging the condensate, which is generated on the surface of the high temperature fluid side of the heat transferring face, on the heat transferring face, forming the patterns of irregularity in the zones, which are obtained by dividing the surface of the high temperature fluid side of the heat transferring face by means of the above-mentioned condensate discharging trough portion, receiving the condensate, which is generated on the heat transferring face to flow down, by means of the condensate discharging trough portion, and discharging the condensate smoothly along the condensate discharging trough portion, it is possible to prevent the condensate from staying on the heat transferring face to improve the contact efficiency of the heat transferring face and the gaseous high temperature fluid. Consequently, it is possible to improve the heat transfer efficiency from the high temperature fluid to the low temperature fluid on the heat transferring face, in addition to improvement in the heat transfer efficiency between the high temperature fluid and the heat transferring face by means of the pattern of irregularity formed thereon, thus causing an effective condensation of the high temperature fluid.

There may be adopted, as the occasion demands, a structure that said condensate discharging trough portion is formed from a side edge of the heat transferring face toward a central portion thereof; and there is provided a condensate flowing passage portion having a second groove portion that is formed on the surface of the heat transferring face so as to extend in the flowing direction of the high temperature fluid from a central portion in the flowing direction of the high temperature fluid of the heat transferring face to a high temperature fluid outlet side end thereof, said condensate flowing passage portion communicating with said condensate discharging trough portion. According to the present invention, by forming the condensate flowing passage portion as well as the condensate discharging trough portion on the heat transferring face, receiving the condensate, which is generated on the heat transferring face to flow down, by means of the condensate discharging trough portion to collect it therein, and further collecting the condensate in the condensate flowing passage portion to discharge it smoothly along the condensate flowing passage portion, it is possible to prevent the condensate from staying on the heat transferring face, improve the contact efficiency of the heat transferring face and the gaseous high temperature fluid, thus causing an effective condensation of the high temperature fluid.

There may be adopted, as the occasion demands, a structure that said heat transferring face is divided into the zones by said at least one condensate discharging trough portion, and said zones have the prescribed patterns of irregularity, each of said prescribed patterns of irregularity having a common concavo-convex shape to each other and an inverse relationship to each other in concavo-convexities that appear on opposite surfaces of said heat transferring face, which locate on the high and low temperature fluids sides, respectively; and each of the prescribed patterns of irregularity is formed by combining, on a basis of a prescribed arrangement, at least one concavo-convex shape portion having a size by which a maximum coefficient of heat transfer from the high temperature fluid can be provided, on the one hand, with at least one concavo-convex shape portion having a size by which a maximum coefficient of heat transfer relative to the low temperature fluid can be provided, on the other hand. According to the present invention, by combining the shape portion having the size by which the maximum coefficient of heat transfer from the high temperature fluid can be provided, on the one hand, with the shape portion having the size by which the maximum coefficient of heat transfer relative to the low temperature fluid can be provided, on the other hand, to form the patterns of irregularity in the zones into which the heat transferring face is divided by the condensate discharging trough portion, so as to maintain the high heat transfer efficiency between the respective fluids and the heat transferring face, it is possible to improve the heat transfer efficiency from the high temperature fluid to the low temperature fluid over the entirety of the heat transferring face, thus causing an effective condensation of the high temperature fluid.

There may be adopted, as the occasion demands, a structure that the pattern of irregularity of at least one of the zones of said heat transferring face is formed by combining a concavo-convex shape having a wavy cross section, which extends in the flowing direction of the high temperature fluid in a shape of elongated projections or grooves that are arranged in parallel with each other in the flowing direction of the low temperature fluid by a prescribed pitch by which a maximum coefficient of heat transfer relative to the low temperature fluid can be provided, on the one hand, with another concavo-convex shape having a wavy cross section, which extends in the flowing direction of the high temperature fluid in a shape of elongated projections or grooves that are arranged in parallel with each other in the flowing direction of the low temperature fluid by another prescribed pitch by which a maximum coefficient of heat transfer from the high temperature fluid can be provided, on the other hand. According to the present invention, by forming the pattern of irregularity in a prescribed region of the heat transferring face, which pattern extends in parallel with the flowing direction of the high temperature fluid and in the perpendicular direction to the flowing direction of the low temperature fluid so as to increase the resistance to the flow of the low temperature fluid, it is possible to improve the contact efficiency of the low temperature fluid and the heat transferring face to cause a further effective heat transfer from the heat transferring face to the low temperature fluid. In addition, it is possible to reduce the inflow resistance of the high temperature fluid to cause it to flow smoothly between the heat transferring faces to make a contact therewith. Consequently, the heat transfer efficiency from the high temperature fluid to the low temperature fluid through the heat transferring face can be improved, thus causing an effective condensation of the high temperature fluid.

There may be adopted, as the occasion demands, a structure that the pattern of irregularity of at least one of zones of said heat transferring face, which locates upstream in the flowing direction of the high temperature fluid relative to said condensate flowing passage portion, is formed by combining a concavo-convex shape having a wavy cross section, which extends in an oblique direction to the flowing direction of the high temperature fluid by a prescribed angle in a shape of elongated projections or grooves that are arranged in parallel with each other in a perpendicular direction to said oblique direction by a prescribed pitch by which a maximum coefficient of heat transfer relative to the low temperature fluid can be provided, on the one hand, with another concavo-convex shape having a wavy cross section, which extends in an oblique direction to the flowing direction of the high temperature fluid by a prescribed angle in a shape of elongated projections or grooves that are arranged in parallel with each other in a perpendicular direction to said oblique direction by another prescribed pitch by which a maximum coefficient of heat transfer relative to the high temperature fluid can be provided, on the other hand. According to the present invention, by forming the pattern of irregularity in a prescribed region of the heat transferring face, which pattern has the shape extending in the oblique direction to the flowing direction of the high temperature fluid by a prescribed angle, to increase the resistance to the flow of the low temperature fluid and to impart a prescribed resistance to the flow of the high temperature fluid, it is possible to improve the contact efficiency between the low temperature fluid and the heat transferring face, thus causing a further effective heat transfer from the heat transferring face to the low temperature fluid. In addition, it is possible to improve the contact efficiency between the high temperature fluid and the heat transferring face, resulting in improvement in heat transfer from the high temperature fluid to the heat transferring face. Even when the high temperature fluid is superheated steam, heat can appropriately be transferred from the superheated steam to the heat transferring face, thus causing an effective condensation of the high temperature fluid.

There may be adopted, as the occasion demands, a structure that said pattern of irregularity is formed in a concavo-convex shape having a combined wavy cross section, which is obtained by combining the elongated projections or grooves that are arranged in parallel with each other by a prescribed pitch by which the maximum coefficient of heat transfer relative to the low temperature fluid can be provided, on the one hand, with the other elongated projections or grooves that are arranged in parallel with each other by a smaller pitch than said prescribed pitch, by which smaller pitch the maximum coefficient of heat transfer from the high temperature fluid can be provided, on the other hand, into an integral body. According to the present invention, by forming the pattern of irregularity of the heat transferring face in the concavo-convex shape having the combined wavy cross section so that potions, i.e., the shaped portion by which the maximum coefficient of heat transfer from the high temperature fluid can be provided and the other shaped portion by which the maximum coefficient of heat transfer relative to the low temperature fluid can be provided, can be arranged uniformly on the heat transferring face without making a biased arrangement, it is possible to arrange the elongated projections or grooves in the maximum number by a small pitch by which the maximum coefficient of heat transfer from the high temperature fluid can be provided. It is therefore possible to discharge the condensate from the heat transferring face in a proper manner to ensure the maximum area for the heat transfer, which can come into contact with the gaseous high temperature fluid, so as to maintain the maximum condensation heat transfer efficiency. It is possible to provide the high heat transfer efficiency between the respective fluids and the heat transferring face to maximize the heat transfer efficiency from the high temperature fluid to the low temperature fluid over the entirety of the heat transferring face, thus further improving the condensation efficiency of the high temperature fluid.

There may be adopted, as the occasion demands, a structure that said heat transferring face has, on its prescribed region extending from a high temperature fluid inlet side end in the flowing direction of the high temperature fluid, a pattern of irregularity having a concavo-convex shape having a wavy cross section, which extends in the flowing direction of the high temperature fluid in a shape of elongated projections or grooves that are arranged in parallel with each other in the flowing direction of the low temperature fluid by a prescribed pitch. According to the present invention, by forming, in the prescribed region on the high temperature fluid inlet side end of the heat transferring face, the pattern of irregularity having the prescribed shape, the longitudinal direction of which coincide with the flowing direction of the high temperature fluid so as to cause the gaseous high temperature fluid to flow easily on the heat transferring face, it is possible to ensure a large heat transfer area by the pattern of irregularity so as to facilitate the contact of the low temperature fluid with the region extending from the high temperature fluid inlet: side end of the heat transferring face, thus causing a proper heat transfer. In addition, it is possible to reduce the inflow resistance of the high temperature fluid to cause it to flow smoothly between the heat transferring faces to make a contact therewith. Consequently, the heat transfer efficiency from the high temperature fluid to the heat transferring face can be improved, thus causing an effective condensation of the high temperature fluid.

There may be adopted, as the occasion demands, a structure that said heat transferring face has, on its prescribed region extending from a high temperature fluid outlet side end in the flowing direction of the high temperature fluid, a pattern of irregularity having a concavo-convex shape having a wavy cross section, which extends in the flowing direction of the high temperature fluid in a shape of elongated projections or grooves that are arranged in parallel with each other in the flowing direction of the low temperature fluid by a prescribed pitch. According to the present invention, by forming, in the prescribed region on the high temperature fluid inlet side end of the heat transferring face, the pattern of irregularity having the prescribed shape, the longitudinal direction of which coincides with the flowing direction of the high temperature fluid so as to decrease the resistance in the high temperature fluid, it is possible to facilitate the discharge of the high temperature fluid in a liquid phase from the heat transferring face to the outside. Consequently, it is possible to prevent the condensate from staying on the heat transferring face for a long period of time so that a large heat transferring area between the heat transferring face and the gaseous high temperature fluid can be ensured, thus causing a further effective condensation of the high temperature fluid.

There may be adopted, as the occasion demands, a structure that said heat transferring face is formed of the plate-shaped material having a rectangular or square shape, sides of which coincide with the flowing directions of the high and low temperature fluids, respectively; and the pattern of irregularity of each of the zones of said heat transferring face is symmetrical relative to a bisector of the heat transferring face, which is in parallel with the flowing direction of the low temperature fluid. According to the present invention, it is possible to use the heat transferring face in the normal state as well as in the inside-out turning state so that the heat transferring faces having the same shape can form the opposing members, thus reducing the cost of the condenser itself, by making the pattern of irregularity of each of the zones of the heat transferring face symmetrical relative to the bisector of the heat transferring face so as to permit to reverse the flowing direction of the low temperature fluid without causing any change in the heat transfer condition.

DETAILED DESCRIPTION OF THE PREFERRED EMBODIMENTS

<First Embodiment of the present invention>

Figure 1:
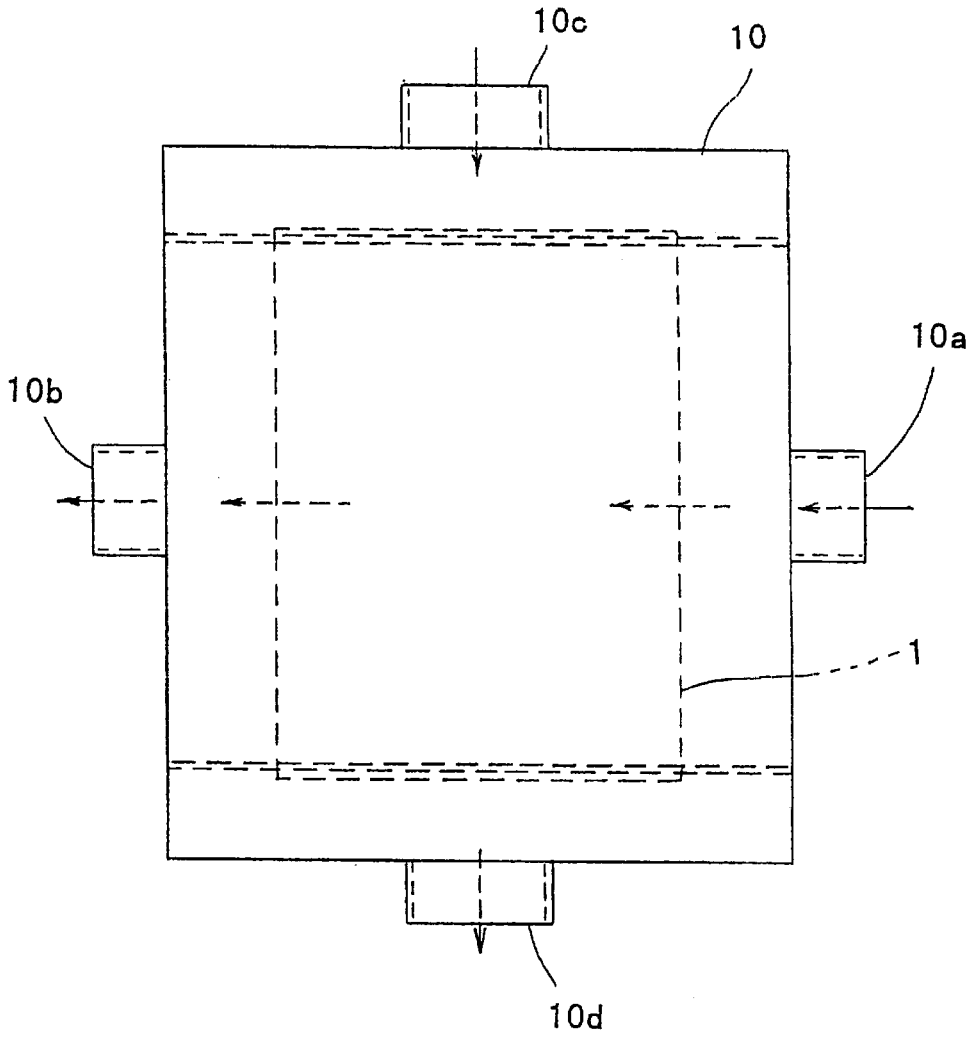
FIG. 1 is a side view illustrating a condenser of the first embodiment of the present invention.

Now, a condenser of the first embodiment of the present invention will be described in detail below with reference to FIGS. 1 to 3. In the condenser of the first embodiment of the present invention, ammonia is used as the high temperature fluid and seawater is used as the low temperature fluid so as to constitute a part of a power cycle. FIG. 1 is a side view illustrating the condenser of the first embodiment of the present invention, FIG. 2 is a schematic constructional view of the heat transferring face of the condenser of the first embodiment of the present invention and FIG. 3 is a perspective view of the essential part of the heat transferring face of the condenser of the first embodiment of the present invention, which has a sectioned portion.

Figure 2:
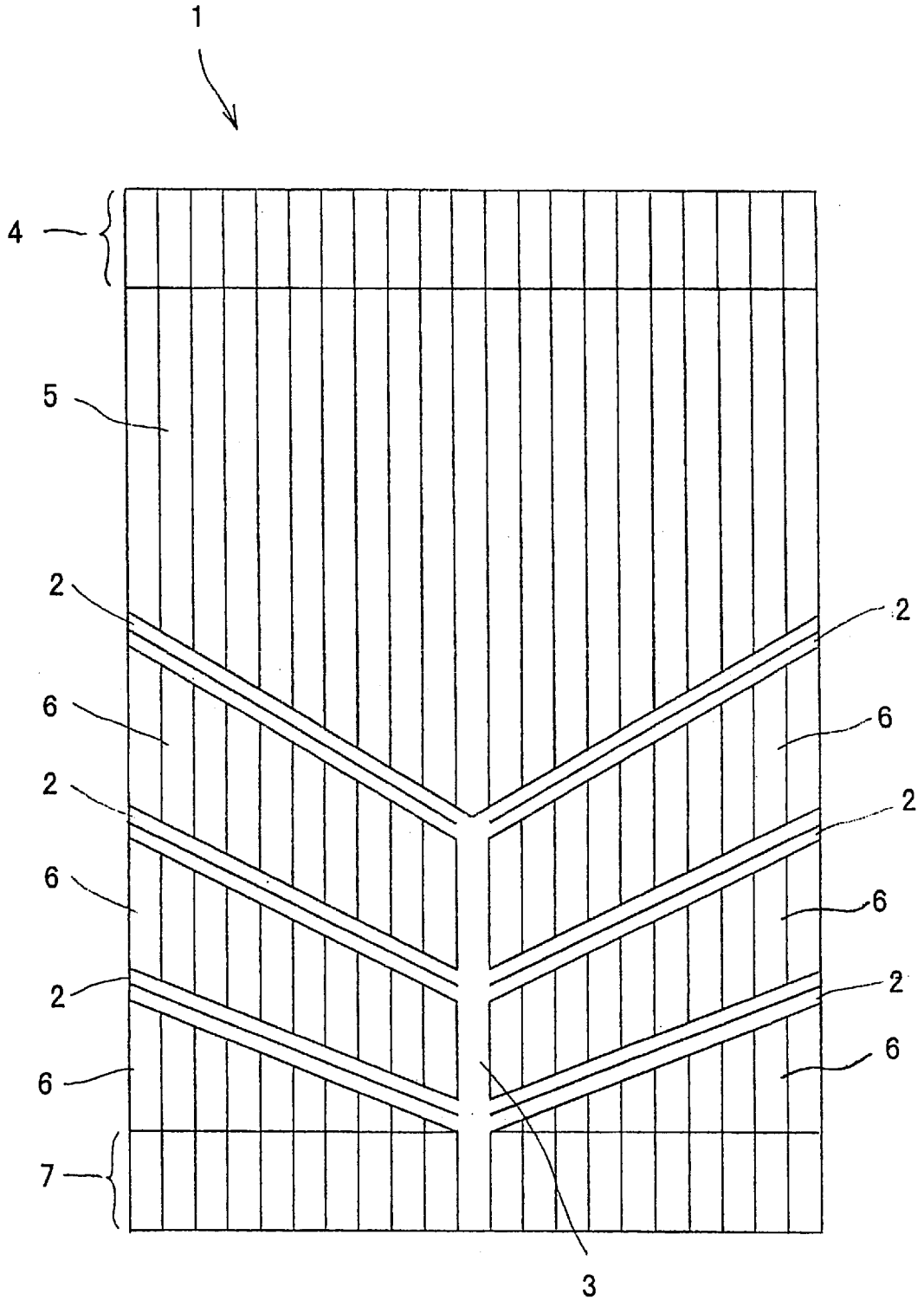
FIG. 2 is a schematic constructional view of the heat transferring face of the condenser of the first embodiment of the present invention.
Figure 3:
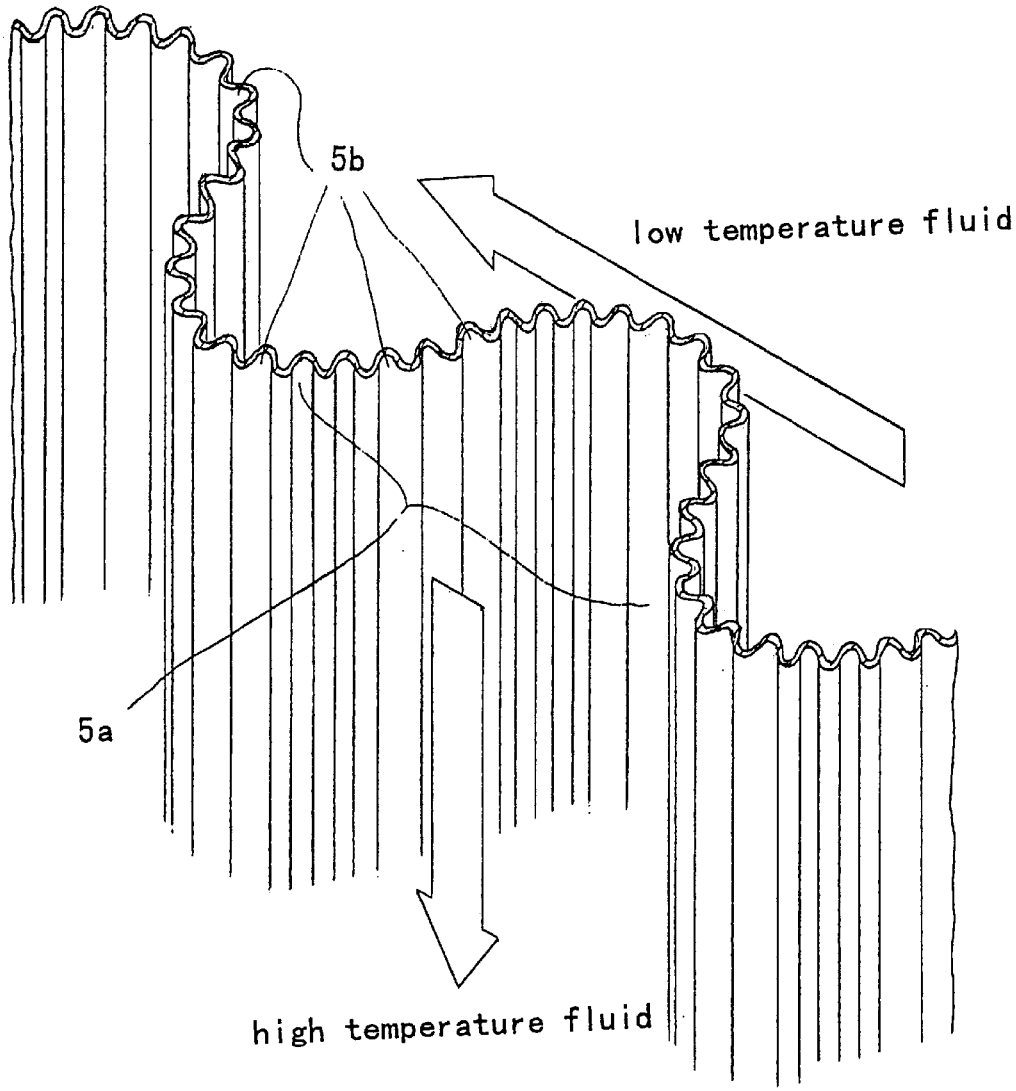
FIG. 3 is a perspective view of the essential part of the heat transferring face of the condenser of the first embodiment of the present invention, which has a sectioned portion.

As shown in FIGS. 1 to 3, the condenser of the first embodiment of the present invention is composed of a metallic shell 10 having a box-shape and of pairs of heat transferring faces 1, which pairs are arranged in parallel with each other in the shell 10. The two heat transferring faces 1, 1 forming each of the pairs thereof are formed of a metallic rectangular shaped material and are in parallel with each other so that the high temperature fluid can pass between the opposing surfaces of the two heat transferring faces 1, 1. The two heat transferring faces 1, 1 are joined to each other in a fluid-tight condition on their opposite side edges to form a tubular body. The upper and lower openings of the tubular body serve as the outlet and the inlet for the high temperature fluid, respectively, so that the high temperature fluid can flow from the lower portion of the tubular body to the upper portion thereof. The low temperature fluid flows between the shell 10 and the tubular bodies in the direction perpendicular to the flowing direction of the high temperature fluid. The side surfaces of the shell 10 surrounding the heat transferring faces 1 have a supply port 10*a* and a discharge port 10*b* for the low temperature fluid, respectively, which are formed on the positions corresponding to the intermediate portions of the heat transferring faces 1 in the vertical direction thereof. The upper and lower surfaces of the shell 10 have an inlet port 10*c* and an outlet port 10*d* for the high temperature fluid, which communicate with the upper and lower openings of the tubular bodies.

The heat transferring face 1 is provided with a plurality of condensate discharging trough portions 2 and a condensate flowing passage portion 3. Each of the condensate discharging trough portions 2 is composed of a pair of first two groove portions, which extend from the side edge portions of the heat transferring face 1 to the central portion thereof in parallel with each other in the oblique direction to the flowing direction of the high temperature fluid by a prescribed angle. The condensate flowing passage portion 3 is composed of second groove portions that extend in the flowing direction of the high temperature fluid from the central portion in the flowing direction of the high temperature fluid of the heat transferring face 1 to the high temperature fluid outlet side end thereof. The condensate flowing passage portion 3 communicates with the condensate discharging trough portions 2. The heat transferring face 1 has a plurality of zones into which the surface of the heat transferring face 1 is divided by means of the condensate discharging trough portions 2 and the condensate flowing passage portion 3. Each of these zones divided in this manner has on its high temperature fluid side and low temperature fluid side a prescribed pattern of irregularity having a common concavo-convex shape to each other and inverse relationship in concavo-convexities that appears on the opposite surfaces of the heat transferring face 1, which locate on the high and low temperature fluids sides, respectively. Each of the patterns of irregularity has functions of increasing the heat transferring area, improving the strength of the heat transferring face 1, controlling the flow of the fluid and guiding the fluid in the prescribed direction.

The uppermost zone 4 of the heat transferring face 1 is an inlet side of the high temperature fluid. The pattern of irregularity of this zone 4 has a concavo-convex shape having a wavy cross section, which extends in the flowing direction of the high temperature fluid in a shape of elongated projections or grooves that are arranged in parallel with each other in the flowing direction of the low temperature fluid by a prescribed pitch. The pattern of irregularity of the uppermost zone 4, in which the elongated projections or the grooves extend in the flowing direction of the high temperature fluid, causes a small resistance to the inflow of the high temperature fluid.

The zone 5 having the largest area, which locates below the uppermost zone 4 so as to be adjacent thereto, has the pattern of irregularity of a concavo-convex shape having a wavy cross section, which extends in the flowing direction of the high temperature fluid in a shape of elongated projections or grooves that are arranged in parallel with each other in the flowing direction of the low temperature fluid by a prescribed pitch. The above-mentioned concavo-convex shape has a combined wavy cross section, which is obtained by combining (1) the grooves 5*a* having the width of from 15 mm to 20 mm (viewed from the high temperature fluid side) by which the maximum coefficient of heat transfer (i.e., the maximum convective heat transfer coefficient) relative to the low temperature fluid can be provided and (2) the grooves 5*b* having the width of from 0.5 mm to 1 mm (viewed from the high temperature fluid side) by which the maximum coefficient of heat transfer (i.e., the maximum condensing heat transfer coefficient) from the high temperature fluid can be provided under the conditions that ammonia is used as the high temperature fluid and sea water is used as the low temperature fluid into an integral body (see FIG. 3).

Each of the zones 6, which locate below the above-mentioned zone 5 so as to be adjacent thereto, has the pattern of irregularity that is symmetrical relative to the bisector of the heat transferring face 1, which is in parallel with the flowing direction of the low temperature fluid. The pattern of irregularity of these zones 6 has a concavo-convex shape having a wavy cross section, which extends in the flowing direction of the high temperature fluid in a shape of elongated projections or grooves that are arranged in parallel with each other in the flowing direction of the low temperature fluid by a prescribed pitch, in the same manner as in the above-mentioned zone 5.

The lowermost zone 7 of the heat transferring face 1 is an outlet side of the high temperature fluid. The pattern of irregularity of this zone 7 has a concavo-convex shape having a wavy cross section, which extends in the flowing direction of the high temperature fluid in a shape of elongated projections or grooves that are arranged in parallel with each other in the flowing direction of the low temperature fluid by a prescribed pitch, in the same manner as in the above-mentioned zone 4. The pattern of irregularity of the lowermost zone 7, in which the elongated projections or the grooves extend in the flowing direction of the high temperature fluid, causes a small resistance to the outflow of the high temperature fluid.

Connection members (not shown), each of which is formed of a plate-shaped material having a prescribed width, surround the heat transferring faces 1. The connection members connect the two opposing heat transferring faces 1, 1 with each other and form the side faces of the tubular body so that the two opposing heat transferring faces 1, 1 can be spaced in parallel with each other by a prescribed distance. There is adopted the normal structure that the connection members have their smooth surfaces so as to reduce resistance to the flows of the fluids flowing inside and outside the tubular body, respectively. There may be adopted the specific structure that the connection members have a pattern of irregularity, which is obtained by arranging sets of concavo-convex shape at prescribed intervals so that the concavity appears on the high temperature fluid side and the convexity appears on the low temperature fluid side. Such a specific structure improves remarkably the supporting strength of the heat transferring face 1 relative to the pressure applied from the high temperature fluid.

Now, description will be given below of a heat exchange function of the condenser having the above-described construction.

The high temperature fluid in a gaseous phase is supplied downward to the upper portion of the tubular body having the two heat transferring faces 1, 1 through the inlet port 10*c* of the shell 10 under a prescribed pressure so that the high temperature fluid can flow between the heat transferring faces 1, 1 forming the inner surfaces of the tubular body. The low temperature fluid is continuously supplied from the supply port 10*a* of the shell 10, while discharging it from the discharge port 10*b*. The low temperature fluid flows outside the heat transferring faces 1, 1 forming the outer surfaces of the tubular body in the perpendicular direction to the flowing direction of the high temperature fluid, thus making a heat exchange through the heat transferring faces 1, 1.

The low temperature fluid comes into contact with each zone of the heat transferring face 1. The pattern of irregularity of each zone of the heat transferring face 1 extends in the perpendicular direction to the flowing direction of the low temperature fluid to impart resistance to the flow of the low temperature fluid so that the maximum coefficient of heat transfer relative to the low temperature fluid can be provided. A sufficient contact of the low temperature fluid with each zone of the heat transferring face 1 is carried out to receive heat securely from the heat transferring face 1, thus permitting a sufficient heat absorption from the high temperature fluid side.

The high temperature fluid in a gaseous phase first comes into contact with the entirety of the uppermost zone 4 of the heat transferring face 1, between the heat transferring faces 1, 1 forming the inside surfaces of the tubular body. The high temperature fluid reaches the next zone 5, while emitting heat to the low temperature fluid through the heat transferring face 1. In the above-mentioned zone 5, the high temperature fluid condenses on the heat transferring face 1 through the heat transferred to the low temperature fluid so as to generate condensate. Fine droplets generated by the condensation is drawn through the surface tension thereof into the grooves 5*b*, which are arranged by a prescribed pitch, so that a liquid layer of condensate is formed only in the grooves 5b. The condensate is collected into a droplet having a prescribed size in the grooves 5*b*, and flows down under the function of its gravity or the pressure of the flow of the gaseous high temperature fluid to reach the condensate discharging trough portion 2 locating just below the zone 5. The surface tension of the condensate causes the enlargement of the size of the droplets of condensate in the grooves 5*b*. Consequently, it is possible to maintain an extreme small area ratio of the condensate to the heat transferring face 1 and cause the condensate to flow down along the grooves 5*b* to discharge it from the heat transferring face 1 in an appropriate manner. It is therefore possible to ensure the extreme large heat transferring area, with which the gaseous high temperature fluid can come into contact, so that the optimum condensing heat transfer coefficient can be provided.

The gaseous high temperature fluid, which has not as yet condensed in the above-mentioned zone 5 reaches the zone 6 locating downstream. The high temperature fluid, which has condensed on the surface of the heat transferring face 1 is drawn through the surface tension thereof into the grooves in the same manner as described above so that the droplets having the prescribed size flow down one by one to reach the condensate discharging trough portion 2.

The condensate, which has reached the respective condensate discharging trough portions 2, moves smoothly to the central portion of the heat transferring face 1 along the condensate discharging trough portions 2. The condensate can surely be received in any one of the pair of grooves, which are arranged in parallel with each other, without flowing down to the lower zone, so as not to hinder the proper contact of the heat transferring face 1 with the gaseous high temperature fluid, even when an amount of the condensate is increased. The condensate flowing in the condensate discharging trough portions gathers in the condensate flowing passage portion 3 locating in the central portion of the heat transferring face 1. The gathered condensate flows down in the condensate flowing passage portion 3, passes between the heat transferring faces 1 and reaches the lower opening so as to be discharged outside through the outlet port 10*d* of the shell 10.

The high temperature fluid remaining in a gaseous phase is cooled further in the lowermost zone 6 so as to complete the condensation of the gas. The condensate moves downward to separate from the gaseous high temperature fluid so that only the high temperature fluid in a liquid phase remains. The condensate moves smoothly downward along the pattern of irregularity, reaches the lower opening so as to be discharged outside through the outlet port 10*d* of the shell 10 in the same manner as in the condensate flowing in the condensate flowing passage portion 3.

In the condenser of the above-described first embodiment of the present invention, the heat transferring face 1 for making a heat exchange is disposed in the shell 10 and the patterns of irregularity in which the shaped portion by which the maximum coefficient of heat transfer from the high temperature fluid can be provided, on the one hand, and the other shaped portion by which the maximum coefficient of heat transfer relative to the low temperature fluid can be provided, on the other hand, are combined with each other, are formed on the heat transferring face 1, so that a heat exchange between the high temperature fluid and the low temperature fluid can be made through the heat transferring face 1. It is therefore possible to optimize the heat transfer to the low temperature fluid in all the zones of the heat transferring face 1 and cause the high temperature fluid to flow smoothly in the liquid and gaseous phases to achieve a sufficient heat transfer to the heat transferring face 1. Consequently, it is possible to maintain the conditions in which the excellent heat transfer efficiency between the respective fluids and the heat transferring face 1 can be obtained, so as to optimize the heat transfer from the high temperature fluid to the low temperature fluid on the entirety of the heat transferring face 1, thus causing an effective condensation of the high temperature fluid.

In the condenser of the first embodiment of the present invention, the shell 10 has the single outlet port 10*c* and the single inlet port 10*d*. The shell 10 is not limited to such a structure and the outlet port and the inlet port may be formed in plural number, respectively. According to such a structure, it is possible to supply uniformly the high temperature fluid into the tubular body forming the heat transferring faces 1, even when the condenser has a large width in the horizontal direction due to the increased number of the heat transferring face and the expanded area thereof.

<Second Embodiment of the present invention>

Figure 4:
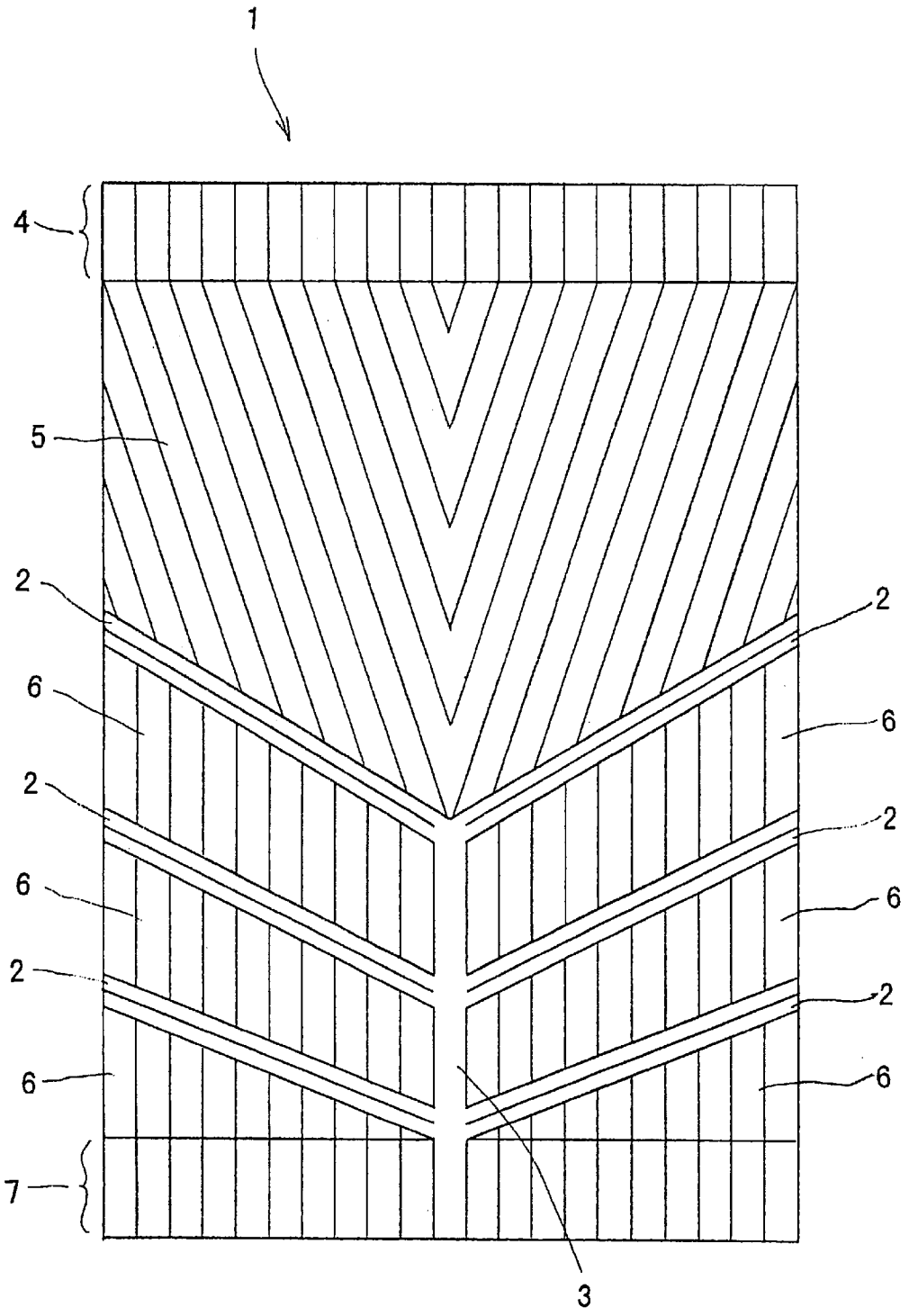
FIG. 4 is a schematic constructional view of the heat transferring face of the condenser of the second embodiment of the present invention.

Now, the condenser of the second embodiment of the present invention will be described in detail below with reference to FIGS. 4 and 5. In the condenser of the second embodiment of the present invention, ammonia is used as the high temperature fluid and brine (refrigerant) is used as the low temperature fluid so as to constitute a part of a refrigerating cycle. FIG. 4 is a schematic constructional view of the heat transferring face of the condenser of the second embodiment of the present invention and FIG. 5 is a perspective view of the essential part of the heat transferring face of the condenser of the second embodiment of the present invention, which has a sectioned portion.

Figure 5:
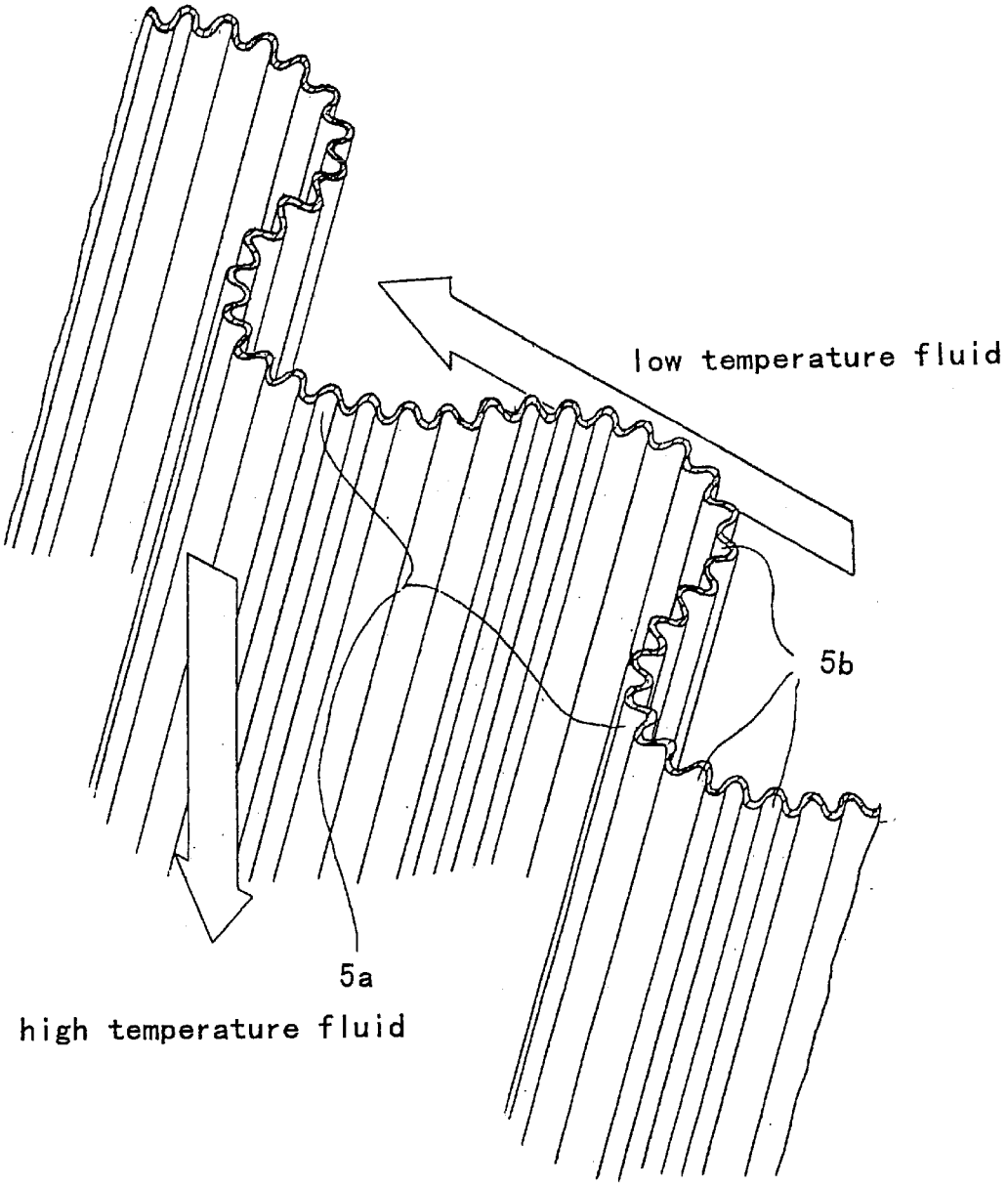
FIG. 5 is a perspective view of the essential part of the heat transferring face of the condenser of the second embodiment of the present invention, which has a sectioned portion.
Figure 6:
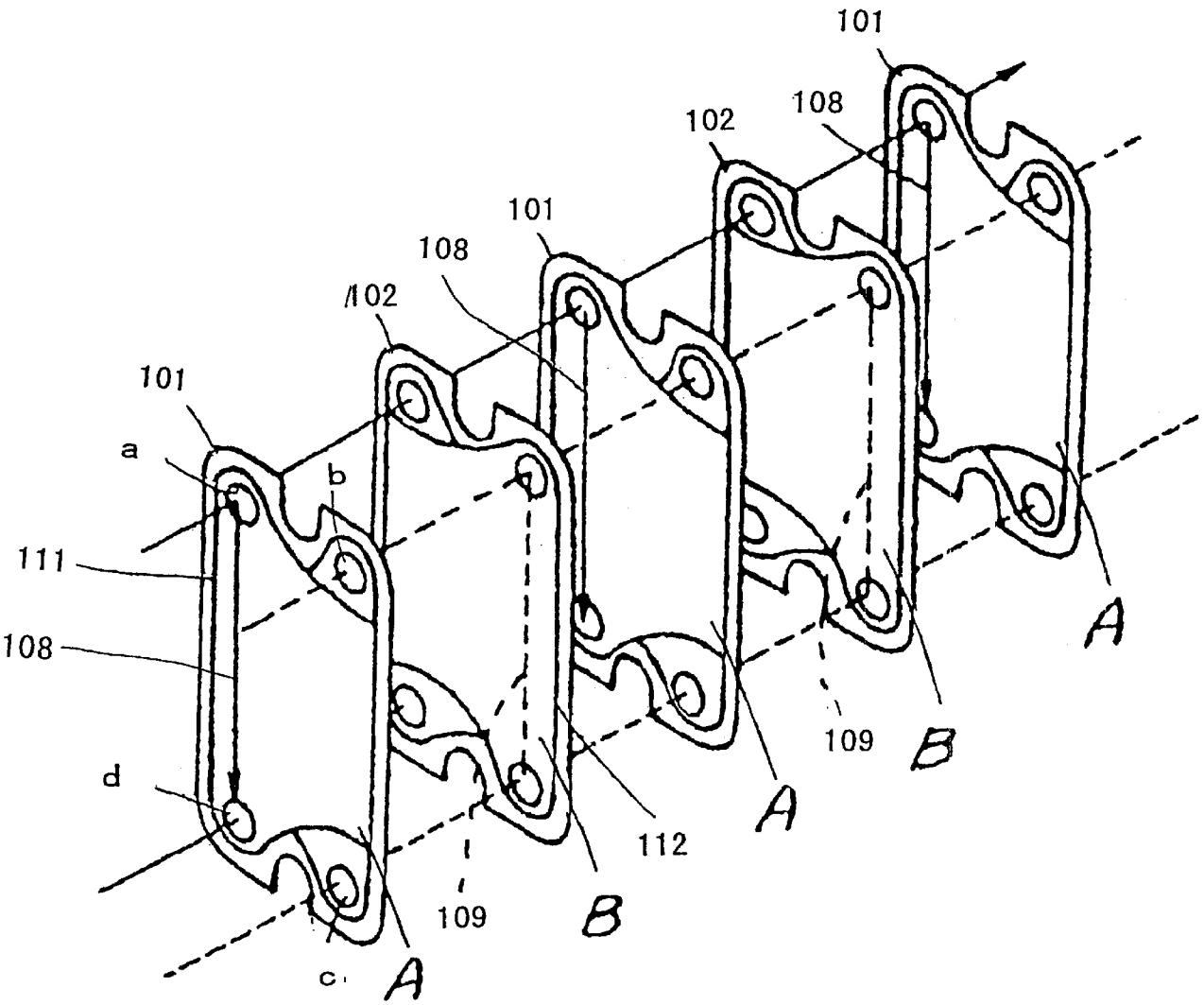
Fig. 6 (Prior Art)
FIG. 6 is an exploded perspective view of the essential part of the conventional condenser.
Figure 7:
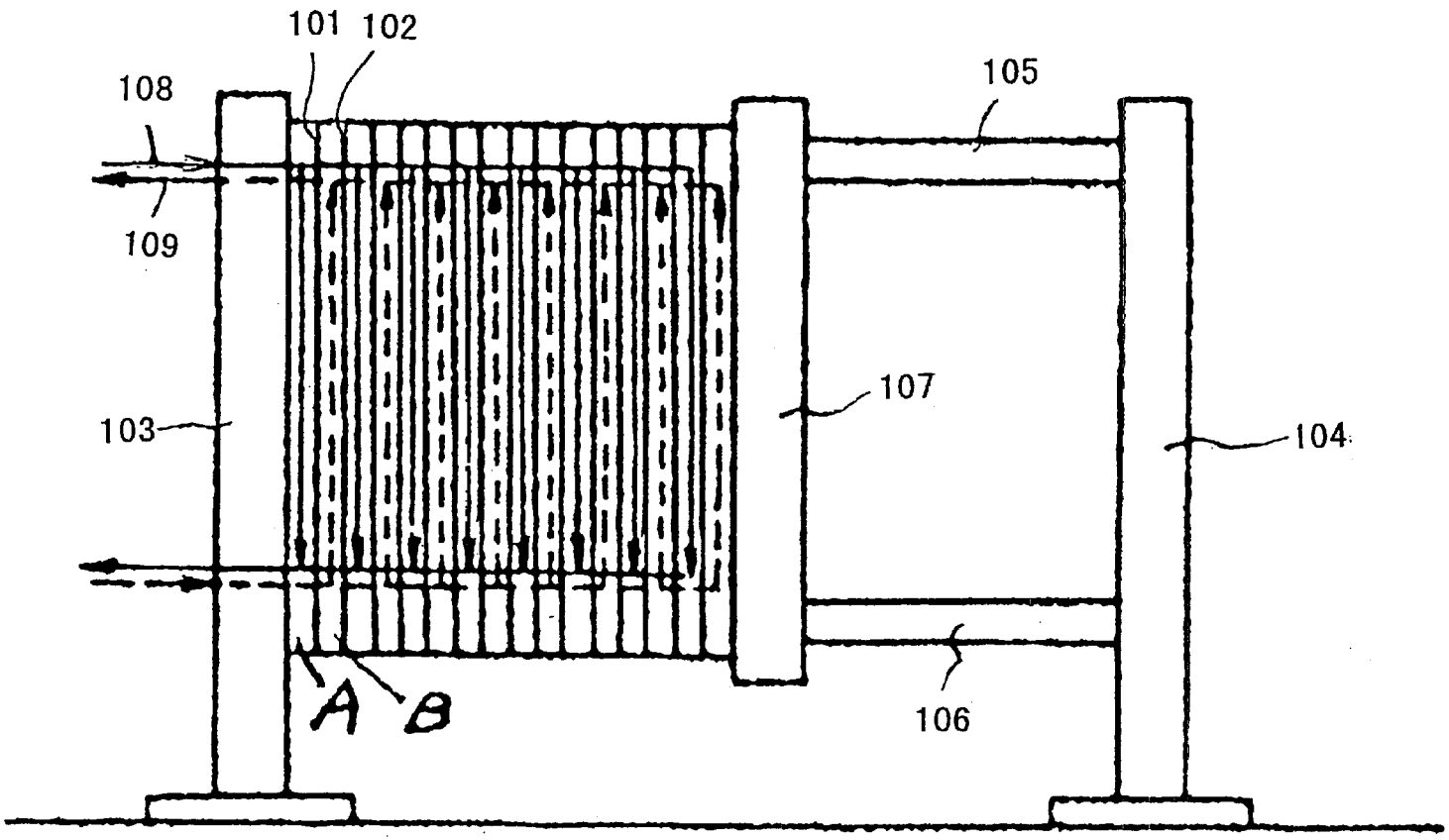
Fig. 7 (Prior Art)
FIG. 7 is a schematic descriptive view of the conventional condenser in its assembling state.
Figure 8:
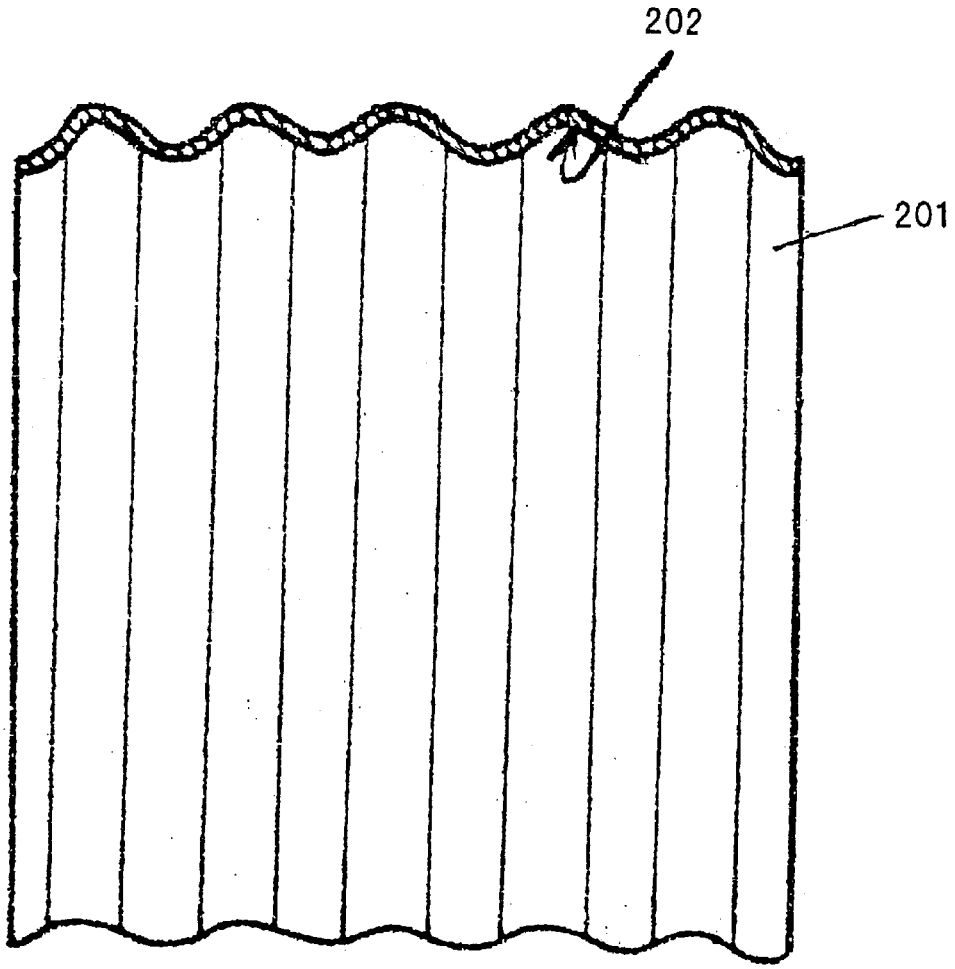
Fig. 8 (Prior Art)
FIG. 8 is a schematic constructional view of the heat transferring face of another conventional condenser.
Figure 9:
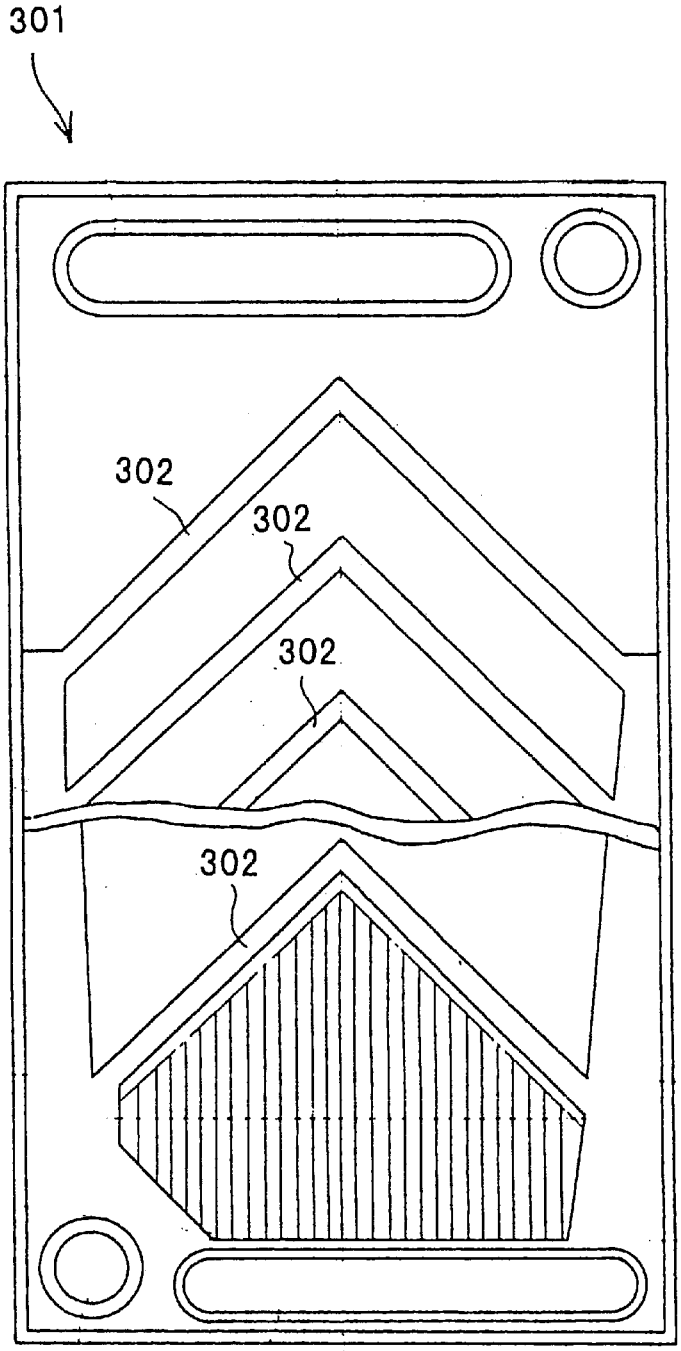
Fig. 9 (Prior Art)
FIG. 9 is a schematic constructional view of the heat transferring face of further another conventional condenser.

As shown in FIGS. 4 and 5, in the condenser of the second embodiment of the present invention, pairs of heat transferring faces 1, which pairs are arranged in parallel with each other to form a tubular body, are disposed in a shell 10 in the same manner as the above-described first embodiment of the present invention. The high and low temperature fluids flow on the opposite surfaces of the heat transferring face 1 so that the flowing direction of the high temperature fluid is perpendicular to the flowing direction of the low temperature fluid. The heat transferring face 1 has the patterns of irregularity, a part of which is different from that of the first embodiment of the present invention.

The heat transferring face 1 is provided with a plurality of condensate discharging trough portions 2 and a condensate flowing passage portion 3. The heat transferring face 1 has a plurality of zones into which the surface of the heat transferring face 1 is divided by means of the condensate discharging trough portions 2 and the condensate flowing passage portion 3. These zones have the prescribed patterns of irregularity. The pattern of irregularity of the zone 5 locating below the uppermost zone 4 so as to be adjacent thereto, has a concavo-convex shape having a wavy cross section, which extends in the oblique direction to the flowing direction of the high temperature fluid by a prescribed angle in a shape of elongated projections or grooves that are arranged in parallel with each other in the perpendicular direction to the above-mentioned oblique direction by a prescribed pitch. The above-mentioned concavo-convex shape is symmetrical relative to the vertical bisector of the heat transferring face 1. The concavo-convex shape has a combined wavy cross section, which is obtained by combining (1) the grooves 5*a* having the width of from 10 mm to 20 mm (viewed from the high temperature fluid side) by which the maximum coefficient of heat transfer (i.e., the maximum convective heat transfer coefficient) relative to the low temperature fluid can be provided and (2) the grooves 5*b* having the width of from 0.5 mm to 1 mm (viewed from the high temperature fluid side) by which the maximum coefficient of heat transfer (i.e., the maximum condensing heat transfer coefficient) from the high temperature fluid can be provided under the conditions that ammonia is used as the high temperature fluid and water is used as the low temperature fluid into an integral body (see FIG. 5) These features are different from those in the first embodiment of the present invention.

Now, description will be given below of a heat exchange function of the condenser having the above-described construction.

The high temperature fluid in a gaseous phase, which exists as superheated steam in the refrigerating cycle is supplied downward to the upper portion of the tubular body having the two heat transferring faces 1, 1 so that the high temperature fluid can flow between the heat transferring faces 1, 1 forming the inner surfaces of the tubular body. The low temperature fluid is continuously supplied from the supply port 10*a* of the shell 10, while discharging it from the discharge port 10*b*. The low temperature fluid flows outside the heat transferring faces 1, 1 forming the outer surfaces of the tubular body in the perpendicular direction to the flowing direction of the high temperature fluid, thus making a heat exchange through the heat transferring faces 1, 1 (see FIG. 1) .

The low temperature fluid comes into contact with each zone of the heat transferring face 1. The zones of the heat transferring face 1 have the patterns of irregularity by which the maximum coefficient of heat transfer relative to the low temperature fluid can be provided. A sufficient contact of the low temperature fluid with each zone of the heat transferring face 1 is carried out to receive heat securely from the heat transferring face 1, thus permitting a sufficient heat absorption from the high temperature fluid side.

The gaseous high temperature fluid existing in a superheating condition first comes into contact with the entirety of the uppermost zone 4 of the heat transferring face 1, between the heat transferring faces 1, 1 forming the inside surfaces of the tubular body. The high temperature fluid reaches the next zone 5, while emitting heat to the low temperature fluid through the heat transferring face 1.

In the above-mentioned zone 5, the high temperature fluid having the flowing velocity, which is decreased by the resistance of the pattern of irregularity, flows downward. The gaseous high temperature fluid comes into contact with all the zones of the heat transferring face 1 to emit heat to the low temperature fluid through the heat transferring face 1 so as to be in a saturated state. The high temperature fluid moves further downward to come into contact with the heat transferring face 1 so as to cause condensation of the high temperature fluid on the heat transferring face 1 through the heat transfer to the low temperature fluid, thus generating condensate. Fine droplets generated by the condensation is drawn through the surface tension thereof into the grooves 5*b*, which are arranged by a prescribed pitch, so that a liquid layer of condensate is formed only in the grooves 5*b*. The condensate is collected into a droplet having a prescribed size in the grooves 5*b*, and flows down under the function of its gravity or the pressure of the flow of the gaseous high temperature fluid to reach the condensate discharging trough portion 2 locating just below the zone 5. The surface tension of the condensate causes the enlargement of the size of the droplets of condensate in the grooves 5*b*. Consequently, it is possible to maintain an extreme small area ratio of the condensate to the heat transferring face 1 and cause the condensate to flow down along the grooves 5*b* to discharge it from the heat transferring face 1 in an appropriate manner. It is therefore possible to ensure the extreme large heat transferring area, with which the gaseous high temperature fluid can come into contact, so that the optimum condensing heat transfer coefficient can be provided.

The gaseous high temperature fluid, which has not as yet condensed in the above-mentioned zone 5, is also in a saturated state. The high temperature fluid condenses on the surface of the heat transferring face 1 in the zone 6 locating downstream in the same manner as the first embodiment of the present invention and is drawn through the surface tension thereof into the grooves so that the droplets having the prescribed size flow down one by one to reach the condensate discharging trough portion 2. The condensate, which has reached the respective condensate discharging trough portions 2, moves to the condensate flowing passage portion 3 locating in the central portion of the heat transferring face 1 to gather therein in the same manner as the first embodiment of the present invention. The gathered condensate flows down in the condensate flowing passage portion 3, passes between the heat transferring faces 1 and reaches the lower opening so as to be discharged outside through the outlet port 10*d* of the shell 10. The high temperature fluid remaining in a gaseous phase is cooled further in the lowermost zone 6 so as to complete the condensation of the gas. The condensate moves smoothly downward along the pattern of irregularity, reaches the lower opening so as to be discharged outside through the outlet port 10*d* of the shell 10.

In the condenser of the above-described second embodiment of the present invention, the heat transferring face 1 for making a heat exchange is disposed in the shell 10 and the patterns of irregularity in which the shaped portion by which the maximum coefficient of heat transfer from the high temperature fluid can be provided, on the one hand, and the other shaped portion by which the maximum coefficient of heat transfer relative to the low temperature fluid can be provided, on the other hand, are combined with each other, are formed on the heat transferring face 1 in the oblique direction to the flowing direction of the high temperature fluid by a prescribed angle, so that a heat exchange between the high temperature fluid and the low temperature fluid can be made through the heat transferring face 1. It is therefore possible to improve the contact efficiency of the high temperature fluid with the heat transferring face 1, in addition to the effect that there can be maintained the conditions in which the excellent heat transfer efficiency between the respective fluids and the heat transferring face 1 can be obtained. As a result, an appropriate heat transfer from the high temperature fluid to the heat transferring face 1, thus causing an effective condensation of the high temperature fluid, even when the high temperature fluid is a superheated steam.

In the condensers of the above-described first and second embodiments of the present invention, the concavo-convex shape of the zone 5 of the heat transferring face 1 has a combined wavy cross section, which is obtained by combining (1) the grooves 5*a* having the large width by which the maximum coefficient of heat transfer relative to the low temperature fluid can be provided and (2) the grooves 5*b* having the small width by which the maximum coefficient of heat transfer from the high temperature fluid can be provided. The pattern of irregularity is not limited only to such a structure. The arrangement may be altered by alternating the groove 5*a* having the large width and the groove 5*b* having the small width. The grooves having the same width may be arranged in parallel with each other. When mixed fluid is used as the high temperature fluid, it is possible to arrange the kinds of grooves alternatively or in sets of them, which have widths corresponding to the difference in surface tension of liquids forming the mixed fluid mentioned above so that the heat transfer and the condensation can be made in an optimized condition for each of the mixed fluid. The values of the width of the grooves are not limited only to those mentioned above. When the high and low temperature fluids to be used are different in their kinds from each other, the grooves may have their appropriate widths in accordance with the kinds of the fluids. Even when the low temperature fluid includes contaminants such as microorganisms, the use of the shape by which the coefficient of heat transfer relative to the low temperature fluid can be optimized makes it possible to prevent such contaminants from staying on the surface of the low temperature fluid side of the heat transferring face, thus ensuring the proper heat transferring property relative to the low temperature fluid.

In the condensers of the first and second embodiments of the present invention, the two heat transferring faces 1, 1 are arranged in parallel with each other so that the high temperature fluid can pass between these faces 1, 1, and joined to each other in a fluid-tight condition on their opposite side edges to form a tubular body so that the upper and lower openings of the tubular body serve as the outlet and the inlet for the high temperature fluid, respectively. The condenser of the present invention is not limited to such a structure. There may be adopted another structure that (i) heat transferring faces having their opening (through-holes) are placed one upon another in the vertical direction in the shell 10, while placing packing materials between the adjacent two faces, (ii) a closed space for the high temperature fluid as well as an opened space for the low temperature fluid are formed, (iii) upper and lower openings communicating with the above-mentioned closed space is used as a passage for the high temperature fluid and (iv) the high temperature fluid is caused to flow down from the upper opening to the lower opening to achieve condensation, in the same manner as the conventional shell and plate type condenser.

In the condensers of the first and second embodiments of the present invention, the heat transferring face 1 has the zones into which the surface of the heat transferring face 1 is divided by means of the condensate discharging trough portions 2 and the condensate flowing passage portion 3 and such zones have the prescribed patterns of irregularity. When there is a difference in pressure between the high temperature fluid and the low temperature fluid between which the heat transferring face 1 exists, it is possible to bring convex portions of the pattern of irregularity of the one heat transferring face 1 into a partial contact with convex portions of the pattern of irregularity of the opposing heat transferring face 1. Such a supporting system at the contact portions makes it possible to prevent the heat transferring face from warping, thus maintaining a proper prescribed distance between the heat transferring faces 1.

In the condensers of the first and second embodiments of the present invention, the zone 4 of the heat transferring face 1 is used as the high temperature fluid inlet side and the zone 7 thereof is used as the high temperature fluid outlet side. The heat transferring face 1 may be placed upside down so that the zone 7 can be used as the high temperature fluid inlet side and the zone 4 can be used as the high temperature fluid outlet side. According to such an arrangement, the high temperature fluid, which has condensed in the zones of the heat transferring face 1, can flow down to gather in the condensate discharging trough portion 2 and the gathered condensate moves along the condensate discharging trough portion 2 to reach the edge of the heat transferring face 1. It is therefore possible to discharge the condensate from the heat transferring face 1 in a proper manner to ensure the maximum area for the heat transfer, which can come into contact with the gaseous high temperature fluid, so as to improve the condensation heat transfer efficiency.

According to the present invention as described in detail, by providing the condensate discharging trough portion for discharging the condensate, which is generated on the surface of the high temperature fluid side of the heat transferring face, on the heat transferring face, forming the patterns of irregularity in the zones, which are obtained by dividing the surface of the high temperature fluid side of the heat transferring face by means of the above-mentioned condensate discharging trough portion, receiving the condensate, which is generated on the heat transferring face to flow down, by means of the condensate discharging trough portion, and discharging the condensate smoothly along the condensate discharging trough portion, it is possible to prevent the condensate from staying on the heat transferring face to improve the contact efficiency of the heat transferring face and the gaseous high temperature fluid. Consequently, it is possible to improve the heat transfer efficiency from the high temperature fluid to the low temperature fluid on the heat transferring face, in addition to improvement in the heat transfer efficiency between the high temperature fluid and the heat transferring face by means of the pattern of irregularity formed thereon, thus causing an effective condensation of the high temperature fluid.

According to the present invention, by forming the condensate flowing passage portion as well as the condensate discharging trough portion on the heat transferring face, receiving the condensate, which is generated on the heat transferring face to flow down, by means of the condensate discharging trough portion to collect it therein, and further collecting the condensate in the condensate flowing passage portion to discharge it smoothly along the condensate flowing passage portion, it is possible to prevent the condensate from staying on the heat transferring face, improve the contact efficiency of the heat transferring face and the gaseous high temperature fluid, thus causing an effective condensation of the high temperature fluid.

According to the present invention, by combining the shape portion having the size by which the maximum coefficient of heat transfer from the high temperature fluid can be provided, on the one hand, with the shape portion having the size by which the maximum coefficient of heat transfer relative to the low temperature fluid can be provided, on the other hand, to form the patterns of irregularity in the zones into which the heat transferring face is divided by the condensate discharging trough portion, so as to maintain the high heat transfer efficiency between the respective fluids and the heat transferring face, it is possible to improve the heat transfer efficiency from the high temperature fluid to the low temperature fluid over the entirety of the heat transferring face, thus causing an effective condensation of the high temperature fluid.

According to the present invention, by forming the pattern of irregularity in a prescribed region of the heat transferring face, which pattern extends in parallel with the flowing direction of the high temperature fluid and in the perpendicular direction to the flowing direction of the low temperature fluid so as to increase the resistance to the flow of the low temperature fluid, it is possible to improve the contact efficiency of the low temperature fluid and the heat transferring face to cause a further effective heat transfer from the heat transferring face to the low temperature fluid. In addition, it is possible to reduce the inflow resistance of the high temperature fluid to cause it to flow smoothly between the heat transferring faces to make a contact therewith. Consequently, the heat transfer efficiency from the high temperature fluid to the low temperature fluid through the heat transferring face can be improved, thus causing an effective condensation of the high temperature fluid.

According to the present invention, by forming the pattern of irregularity in a prescribed region of the heat transferring face, which pattern has the shape extending in the oblique direction to the flowing direction of the high temperature fluid by a prescribed angle, to increase the resistance to the flow of the low temperature fluid and to impart a prescribed resistance to the flow of the high temperature fluid, it is possible to improve the contact efficiency between the low temperature fluid and the heat transferring face, thus causing a further effective heat transfer from the heat transferring face to the low temperature fluid. In addition, it is possible to improve the contact efficiency between the high temperature fluid and the heat transferring face, resulting in improvement in heat transfer from the high temperature fluid to the heat transferring face. Even when the high temperature fluid is superheated steam, heat can appropriately be transferred from the superheated steam to the heat transferring face, thus causing an effective condensation of the high temperature fluid.

According to the present invention, by forming the pattern of irregularity of the heat transferring face in the concavo-convex shape having the combined wavy cross section so that potions, i.e., the shaped portion by which the maximum coefficient of heat transfer from the high temperature fluid can be provided and the other shaped portion by which the maximum coefficient of heat transfer relative to the low temperature fluid can be provided, can be arranged uniformly on the heat transferring face without making a biased arrangement, it is possible to arrange the elongated projections or grooves in the maximum number by a small pitch by which the maximum coefficient of heat transfer from the high temperature fluid can be provided. It is therefore possible to discharge the condensate from the heat transferring face in a proper manner to ensure the maximum area for the heat transfer, which can come into contact with the gaseous high temperature fluid, so as to maintain the maximum condensation heat transfer efficiency. It is possible to provide the high heat transfer efficiency between the respective fluids and the heat transferring face to maximize the heat transfer efficiency from the high temperature fluid to the low temperature fluid over the entirety of the heat transferring face, thus further improving the condensation efficiency of the high temperature fluid.

According to the present invention, by forming, in the prescribed region on the high temperature fluid inlet side end of the heat transferring face, the pattern of irregularity having the prescribed shape, the longitudinal direction of which coincide with the flowing direction of the high temperature fluid so as to cause the gaseous high temperature fluid to flow easily on the heat transferring face, it is possible to ensure a large heat transfer area by the pattern of irregularity so as to facilitate the contact of the low temperature fluid with the region extending from the high temperature fluid inlet side end of the heat transferring face, thus causing a proper heat transfer. In addition, it is possible to reduce the inflow resistance of the high temperature fluid to cause it to flow smoothly between the heat transferring faces to make a contact therewith. Consequently, the heat transfer efficiency from the high temperature fluid to the heat transferring face can be improved, thus causing an effective condensation of the high temperature fluid.

According to the present invention, by forming, in the prescribed region on the high temperature fluid inlet side end of the heat transferring face, the pattern of irregularity having the prescribed shape, the longitudinal direction of which coincides with the flowing direction of the high temperature fluid so as to decrease the resistance in the high temperature fluid, it is possible to facilitate the discharge of the high temperature fluid in a liquid phase from the heat transferring face to the outside. Consequently, it is possible to prevent the condensate from staying on the heat transferring face for a long period of time so that a large heat transferring area between the heat transferring face and the gaseous high temperature fluid can be ensured, thus causing a further effective condensation of the high temperature fluid.

According to the present invention, it is possible to use the heat transferring face in the normal state as well as in the inside-out turning state so that the heat transferring faces having the same shape can form the opposing members, thus reducing the cost of the condenser itself, by making the pattern of irregularity of each of the zones of the heat transferring face symmetrical relative to the bisector of the heat transferring face so as to permit to reverse the flowing direction of the low temperature fluid without causing any change in the heat transfer condition.

What is claimed is:

1. A condenser comprising:

at least one heat transferring face formed of a plate-shaped material, and having opposite surface sides structurally arranged so that a change of phase of a low temperature fluid from a liquid phase to a gaseous phase is made by causing a high temperature fluid and the low temperature fluid to flow respectively on said opposite surface sides of said heat transferring face, respectively, so that flowing directions of said high and low temperature fluids are perpendicular to each other, to achieve a heat exchange between said fluids, at least one condensate discharging trough portion formed from a side edge of said heat transferring face having a first groove portion formed on a surface of the high temperature fluid side of said heat transferring face so as to extend in an oblique direction to a flowing direction of the high temperature fluid by a prescribed angle, said at least one condensate discharging trough portion being capable of receiving condensate of the high temperature fluid, which is generated on the heat transferring face to flow down in the flowing direction of the high temperature fluid; and where said heat transferring face is divided into a plurality of zones by said at least one condensate discharging trough portion and said zones have prescribed patterns of irregularity, said prescribed patterns of irregularity appearing on at least high temperature fluid side.

2. The condenser as claimed in claim 1, wherein:

said condensate discharging trough portion is formed from a side edge of the heat transferring face toward a central portion thereof; and there is provided a condensate flowing passage portion having a second groove portion that is formed on the surface of the heat transferring face so as to extend in the flowing direction of the high temperature fluid from a central portion in the flowing direction of the high temperature fluid of the heat transferring face to a high temperature fluid outlet side end thereof, said condensate flowing passage portion communicating with said condensate discharging trough portion.

3. The condenser as claimed in claim 1 or 2, wherein:

said heat transferring face is divided into the zones by said at least one condensate discharging trough portion, and said zones have the prescribed patterns of irregularity, each of said prescribed patterns of irregularity having a common concavo-convex shape to each other and an inverse relationship to each other in concavo-convexities that appear on opposite surfaces of said heat transferring face, which locate on the high and low temperature fluids sides, respectively; and each of the prescribed patterns of irregularity is formed by combining, on a basis of a prescribed arrangement, at least one concavo-convex shape portion having a size by which a maximum coefficient of heat transfer from the high temperature fluid can be provided, on the one hand, with at least one concavo-convex shape portion having a size by which a maximum coefficient of heat transfer relative to the low temperature fluid can be provided, on the other hand.

4. The condenser as claimed in claim 3, wherein:

the pattern of irregularity of at least one of the zones of said heat transferring face is formed by combining a concavo-convex shape having a wavy cross section, which extends in the flowing direction of the high temperature fluid in a shape of elongated projections or grooves that are arranged in parallel with each other in the flowing direction of the low temperature fluid by a prescribed pitch by which a maximum coefficient of heat transfer relative to the low temperature fluid can be provided, on the one hand, with another concavo-convex shape having a wavy cross section, which extends in the flowing direction of the high temperature fluid in a shape of elongated projections or grooves that are arranged in parallel with each other in the flowing direction of the low temperature fluid by another prescribed pitch by which a maximum coefficient of heat transfer from the high temperature fluid can be provided, on the other hand.

5. The condenser as claimed in claim 3 or 4, wherein:

the pattern of irregularity of at least one of zones of said heat transferring face, which locates upstream in the flowing direction of the high temperature fluid relative to said condensate flowing passage portion, is formed by combining a concavo-convex shape having a wavy cross section, which extends in an oblique direction to the flowing direction of the high temperature fluid by a prescribed angle in a shape of elongated projections or grooves that are arranged in parallel with each other in a perpendicular direction to said oblique direction by a prescribed pitch by which a maximum coefficient of heat transfer relative to the low temperature fluid can be provided, on the one hand, with another concavo-convex shape having a wavy cross section, which extends in an oblique direction to the flowing direction of the high temperature fluid by a prescribed angle in a shape of elongated projections or grooves that are arranged in parallel with each other in a perpendicular direction to said oblique direction by another prescribed pitch by which a maximum coefficient of heat transfer relative to the high temperature fluid can be provided, on the other hand.

6. The condenser as claimed in claim 4 or 5, wherein:

said pattern of irregularity is formed in a concavo-convex shape having a combined wavy cross section, which is obtained by combining the elongated projections or grooves that are arranged in parallel with each other by a prescribed pitch by which the maximum coefficient of heat transfer relative to the low temperature fluid can be provided, on the one hand, with the other elongated projections or grooves that are arranged in parallel with each other by a smaller pitch than said prescribed pitch, by which smaller pitch the maximum coefficient of heat transfer from the high temperature fluid can be provided, on the other hand, into an integral body.

7. The condenser as claimed in any one of claims 1 to 6, wherein:

said heat transferring face has, on its prescribed region extending from a high temperature fluid inlet side end in the flowing direction of the high temperature fluid, a pattern of irregularity having a concavo-convex shape having a wavy cross section, which extends in the flowing direction of the high temperature fluid in a shape of elongated projections or grooves that are arranged in parallel with each other in the flowing direction of the low temperature fluid by a prescribed pitch.

8. The condenser as claimed in any one of claims 1 to 7, wherein:

said heat transferring face has, on its prescribed region extending from a high temperature fluid outlet side end in the flowing direction of the high temperature fluid, a pattern of irregularity having a concavo-convex shape having a wavy cross section, which extends in the flowing direction of the high temperature fluid in a shape of elongated projections or grooves that are arranged in parallel with each other in the flowing direction of the low temperature fluid by a prescribed pitch.

9. The condenser as claimed in any one of claims 1 to 8, wherein:

said heat transferring face is formed of the plate-shaped material having a rectangular or square shape, sides of which coincide with the flowing directions of the high and low temperature fluids, respectively; and the pattern of irregularity of each of the zones of said heat transferring face is symmetrical relative to a bisector of the heat transferring face, which is in parallel with the flowing direction of the low temperature fluid.

10. A condenser comprising:

at least one heat transferring face formed of a plate-shaped material, and having opposite surface sides structurally arranged so that a change of phase of a low temperature fluid from a liquid phase to a gaseous phase is made by causing a high temperature fluid and the low temperature fluid to flow respectively on said opposite surface sides of said heat transferring face, respectively, so that flowing directions of said high and low temperature fluids are perpendicular to each other, to achieve a heat exchange between said fluids, at least one condensate discharging trough portion formed from a side edge of said heat transferring face having a first groove portion formed on a surface of the high temperature fluid side of said heat transferring face so as to extend in an oblique direction to a flowing direction of the high temperature fluid by a prescribed angle, said at least one condensate discharging trough portion being capable of receiving condensate of the high temperature fluid, which is generated on the heat transferring face to flow down in the flowing direction of the high temperature fluid; and where said heat transferring face is divided into a plurality of zones by said at least one condensate discharging trough portion and said zones have prescribed patterns of irregularity, wherein said prescribed patterns of irregularity have a concavo-convex form with a wavy cross-section throughout each pattern, and said prescribed patterns of irregularity appearing on at least high temperature fluid side.

* * * * *